US006657369B1

(12) United States Patent
Tamaru et al.

(10) Patent No.: US 6,657,369 B1
(45) Date of Patent: Dec. 2, 2003

(54) LAMP WITH REFLECTOR AND METHOD OF MANUFACTURING THE SAME

(75) Inventors: Syuji Tamaru, Hyogo (JP); Takashi Tsutatani, Osaka (JP); Ken Tatsuta, Kyoto (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/440,389

(22) Filed: Nov. 15, 1999

(30) Foreign Application Priority Data

Nov. 18, 1998 (JP) ..... 10-327813

(51) Int. Cl.[7] ..... H01J 5/48

(52) U.S. Cl. ..... 313/318.11; 313/113; 313/318.08; 313/318.09; 313/315; 362/226

(58) Field of Search ..... 313/318.11, 318.09, 313/113, 318.08, 315; 362/226

(56) References Cited

U.S. PATENT DOCUMENTS 4,370,587 A * 1/1983 Notelteirs ..... 313/113
5,053,935 A * 10/1991 Hellwig et al. ..... 362/296
5,206,558 A * 4/1993 Losonczi et al. ..... 313/113
5,465,025 A * 11/1995 Hendrickson ..... 313/318.09
5,466,981 A * 11/1995 Fields et al. ..... 313/113
5,726,525 A * 3/1998 Friederichs ..... 313/318.07
5,744,901 A * 4/1998 Friederichs et al. ..... 313/113
5,806,971 A * 9/1998 Sugihara et al. ..... 362/264
5,839,818 A * 11/1998 Janson et al. ..... 362/226
5,957,569 A * 9/1999 Helbig et al. ..... 362/263
6,147,444 A * 11/2000 Gallant et al. ..... 313/318.01

FOREIGN PATENT DOCUMENTS

JP 10-162627 6/1998
JP 2000182428 * 6/2000 ..... F21V/19/00

* cited by examiner

*Primary Examiner*—Ashok Patel
*Assistant Examiner*—Sikha Roy
(74) *Attorney, Agent, or Firm*—Merchant & Gould P.C.

(57) ABSTRACT

A lamp with a reflector in which a lamp is fixed firmly inside a reflector by fixing the lamp inside the reflector without using an adhesive. The lamp with a reflector includes a lamp having a base at one end and a reflector including, at one end of its reflecting surface, a hole into which the base of the lamp is inserted and an opening portion at the other end. The base is maintained in the hole, so that the lamp is positioned inside the reflector. The lamp is fixed inside the reflector by fitting a hollow metal fitting into the hole, inserting the base into the hollow metal fitting, and then combining the base and the hollow metal fitting into one component by welding. The position of the lamp inside the reflector can be adjusted easily and no process for drying an adhesive is required.

9 Claims, 11 Drawing Sheets

LAMP WITH REFLECTOR AND METHOD OF MANUFACTURING THE SAME

FIELD OF THE INVENTION

The present invention relates to a lamp with a reflector used in optical equipment or the like and to a method of manufacturing the same.

BACKGROUND OF THE INVENTION

Conventionally, a lamp with a reflector having a configuration as shown in FIG. 11 has been known. In FIG. 11, numeral 1 indicates a high-pressure mercury lamp having a light-emitting portion 1*a* with a pair of electrodes 4 and sealing portions 1*b* and 1*c* provided in continuation of the respective ends of the light-emitting portion 1*a*. A metal base 2 provided with a threaded portion 2*a* at one end is fixed to the sealing portion 1*b* with an adhesive 22*a* such as cement or the like. Numeral 40 indicates a reflector. The reflector 40 has an opening portion 6, a reflecting surface 7 that is a paraboloid or an ellipsoid, and a hole 39. The sealing portion 1*b* of the lamp 1 is inserted into the hole 39 and the lamp 1 and the reflector 40 are combined into one component using the adhesive 22*b*.

One electrode 4 is connected to the base 2. To the other electrode 4, a lead wire 5*b* is connected by welding. A front glass 9 is fixed to the opening portion 6 of the reflector 40 by a fixing clamp 10.

In turning on this lamp, a lead wire 5*a* connected to a power supply (not shown in the figure) is connected to the threaded portion 2*a* of the base 2 by thread fastening of a nut 2*b* and a lead wire 5*b* is connected to a power supply (not shown in the Figure).

In such a lamp with a reflector, a method of fixing the lamp 1 to the reflector 40 has been as follows. After the insertion of the sealing portion 1*b* into the hole 39, the hole 39 is filled with the adhesive 22*b* and then the position of the lamp 1 is adjusted so that the lamp is positioned at the focal point of the reflector 40. After that, the adhesive 22*b* is dried to fix the lamp 1 inside the reflector 40. Then, the front glass 9 is fixed to the opening portion 6. In this connection, the step of adjusting the position of the lamp 1 is carried out with the lamp 1 being oriented horizontally and being turned on (hereinafter this state of the lamp 1 is referred to as a "horizontal turn-on state") as in the case where the lamp is used practically. The reason is that an arc bending phenomenon, i.e. a phenomenon in which an emission center is shifted slightly depending on the orientation of the lamp 1 when it is turned on, occurs in the lamp 1.

However, in such a conventional lamp with a reflector, since the lamp 1 is fixed to the hole 39 simply with the adhesive 22*b*, the adhesive strength between the lamp 1 and the adhesive 22 is lost when strong force is added to the base 2 in thread fastening of the nut 2*b* to the threaded portion 2*a* or the like. As a result, the lamp 1 cannot be fixed inside the reflector 40, which has been a problem.

When the lamp 1 is fixed to the reflector 40, a process for drying the adhesive 22 is required and the process takes a long time of at least 30 minutes. This also has been a problem.

Furthermore, there have been the following problems. Since the drying process is carried out by batch processing, it is difficult to obtain the consistency with a mass production line, thus complicating the manufacturing processes. In addition, when the mass-production volume is increased, the size of the drying furnace equipment is increased.

Moreover, in the horizontal turn-on state in adjusting the position of the lamp 1, the adhesive 22*b* moves to one side or flows out due to gravity. Therefore, after the lamp 1 is fixed inside the reflector 40 temporarily by drying a part of the adhesive 22*b* for temporal fixation, the reflector 40 is set again in a direction in which the adhesive 22*b* does not flow out and then the adhesive 22*b* is dried for finishing. Since such two drying steps are required, the process is complicated, which also has been a problem.

In addition, there also has been a possible problem of causing defects due to the accidental adherence of the adhesive 22*b* onto the reflecting surface 7 or the like when the hole 39 is filled with the adhesive 22.

SUMMARY OF THE INVENTION

The present invention aims to solve such problems. It is an object of the present invention to provide a lamp with a reflector in which a lamp can be fixed firmly inside a reflector by fixing the lamp inside the reflector without using an adhesive.

It also is an object of the present invention to provide a method of manufacturing a lamp with a reflector in which the position of a lamp can be adjusted easily inside a reflector by fixing the lamp inside the reflector without using an adhesive, no process for drying an adhesive and no equipment for the process are required, and further the occurrence of defects caused by adhesion of an adhesive can be prevented.

The lamp with a reflector of the present invention includes a lamp having a base at one end and a reflector. The reflector has, at one end of its reflecting surface, a hole into which the base of the lamp is inserted and an opening portion at the other end. The base is maintained in the hole, so that the lamp is positioned inside the reflector. A hollow metal fitting is fit into the hole, the base is inserted into the metal fitting, and the base and the metal fitting are combined into one component by welding. According to this configuration, the lamp can be fixed firmly inside the reflector without using an adhesive.

In the above-mentioned configuration, when the base and the metal fitting are welded at their boundary portion, they can be welded easily and reliably.

Preferably, the metal fitting has at least one slit formed by being cut from an end on the opposite side to the opening portion and has a flexible tongue portion that is formed by the slit. According to this, the tongue portion is deformed elastically and therefore the lamp can be tilted easily in any direction, thus facilitating the position adjustment of the lamp inside the reflector. Further, by providing the hole with a projection or a rib that is engaged with the slit, the length of the metal fitting to be inserted into the hole can be controlled, and when the metal fitting has a cylindrical shape, the rotation in the circumferential direction can be suppressed further securely. In addition, by providing a projection on the side face of the metal fitting and bringing the projection into contact with the inner face of the hole, the metal fitting is allowed to be fit tightly in the hole. Preferably, the above-mentioned slit is formed to extend to the vicinity of the end positioned on the reflector side.

When the hole has a tapered shape with the side of the opening portion of the reflector being wider and the metal fitting is inserted into the hole, the tongue portion is deformed to have its tip closer, thus deforming the metal fitting into a tapered shape. Therefore, the contact force between the base and the tongue portion increases when the base is inserted. In addition, the base seeks to press and expand the tongue portion and therefore the further intimate contact between the metal fitting and the hole also is attained.

It is preferable that a stopper to be caught by the end of the hole on the opening portion side is provided at one end of the metal fitting on the opening portion side. This can prevent the metal fitting from being inserted into the hole beyond a predetermined length.

Besides the above-mentioned slit, by providing the metal fitting with at least one slit formed by being cut from its end of the opening portion side, the difference in thermal expansion between the reflector and the metal fitting is absorbed, thus preventing damages.

Further, when a projection formed of a part of a spherical body is provided on the side face of the base and a top part of the projection is brought into contact with the inner face of the metal fitting, a constant sliding frictional force between the base and the inner face of the metal fitting can be obtained, thus facilitating the position adjustment of the lamp.

The manufacturing method according to the present invention is one for manufacturing a lamp with a reflector including a lamp having a base at one end and a reflector. The reflector has, at one end of its reflecting surface, a hole into which the base of the lamp is inserted and at the other end, an opening portion. The base is maintained in the hole, so that the lamp is positioned inside the reflector. The method is characterized in that a hollow metal fitting is fit into the hole, the base is inserted into the metal fitting, and then the base and the metal fitting are combined into one component by welding. According to this configuration, the lamp can be fixed firmly inside the reflector in a short time and the occurrence of defects caused by adhesion of an adhesive onto the reflecting surface also can be prevented.

DETAILED DESCRIPTION OF THE INVENTION

First Embodiment

Figure 1:
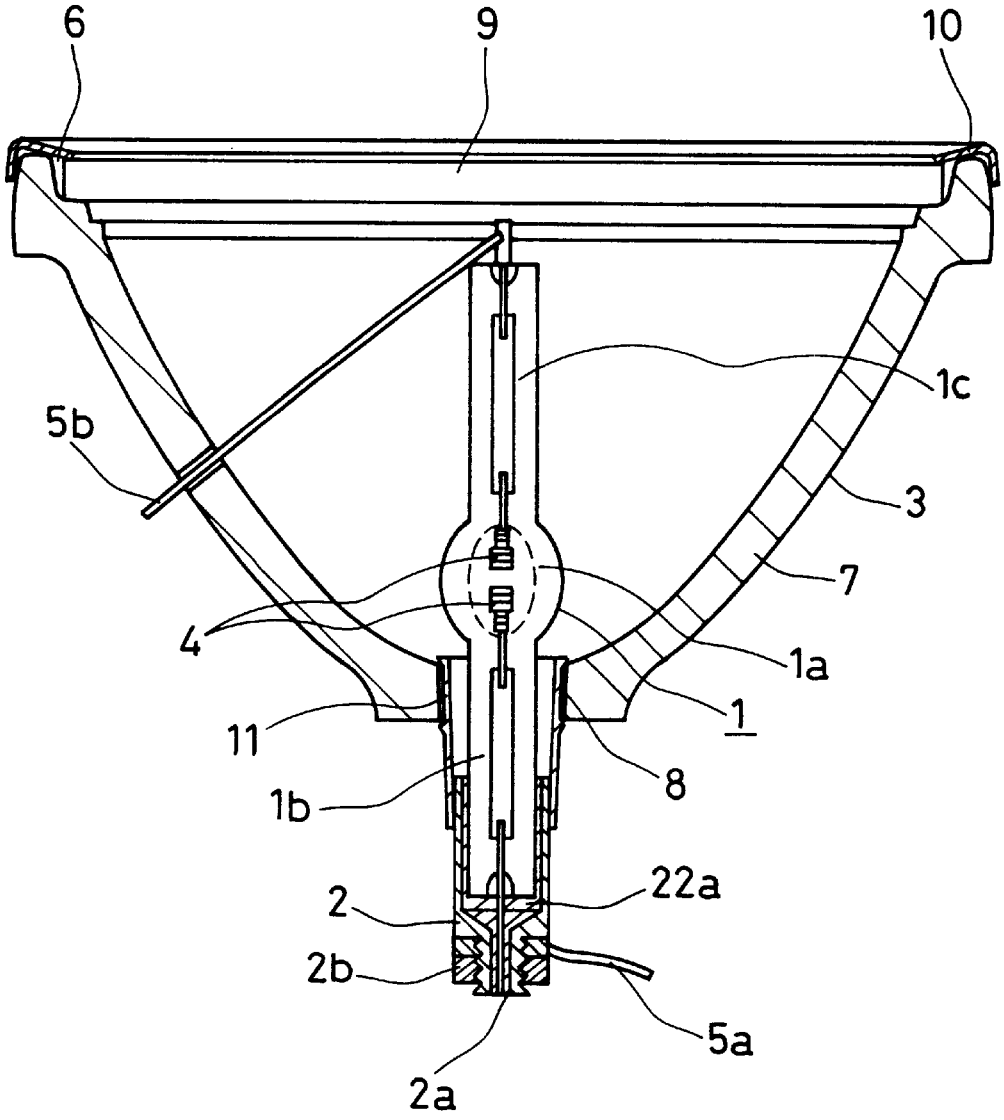
FIG. 1 is a cross sectional view of a lamp with a reflector according to a first embodiment of the present invention.

FIG. 1 shows a lamp with a reflector according to a first embodiment of the present invention. This lamp with a reflector includes: a high-pressure mercury lamp 1 made of quartz glass which may have a rated power of 150W; a metal base 2 that is fixed to one end of the lamp 1 with an adhesive 22*a* such as cement or the like and is provided with a threaded portion 2*a* at one end; and a glass reflector 3 having the lamp 1 positioned in its inside.

The lamp 1 may have an overall length of 80 mm and a maximum outer diameter of 10 mm and is provided with a light-emitting portion 1*a* including a pair of electrodes 4 in its inside and sealing portions 1*b* and 1*c* connected to respective ends of the light-emitting portion 1*a*. A predetermined amount of mercury, rare gases, or the like are sealed inside the light-emitting portion 1*a*. One of the electrodes 4 is connected to the base 2. The other electrode 4 is connected to a lead wire 5*b* passing through the reflector 3.

When turning on the lamp 1, a lead wire 5*a* connected to a power supply (not shown in the figure) is connected to the threaded portion 2*a* of the base 2 by thread fastening of a nut 2*b* and the lead wire 5*b* is connected to a power supply (not shown in the figure).

The reflector 3 has an opening portion 6 on its front side through which light is emitted, a reflecting surface portion 7 that is provided in continuation of the opening portion 6 and that has a paraboloidal or ellipsoidal reflecting surface, and a hole 8 provided in continuation of the reflecting surface portion 7. The opening portion 6 may have an outer diameter of 90 mm and a front glass 9 is fixed to the opening portion 6 by a clamp 10. The hole 8 may have a depth of 8 mm and inner diameters of 12 mm at the end on the opening portion 6 side and 10 mm at the other end so as to have a tapered shape.

A cylindrical metal fitting 11 is fit into the hole 8 with about half the overall length projecting to the outside of the reflector 3. The base 2 is inserted into the metal fitting 11, and the base 2 and the metal fitting 11 are combined into one component by welding, thus fixing the lamp 1 inside the reflector 3.

Figure 2:
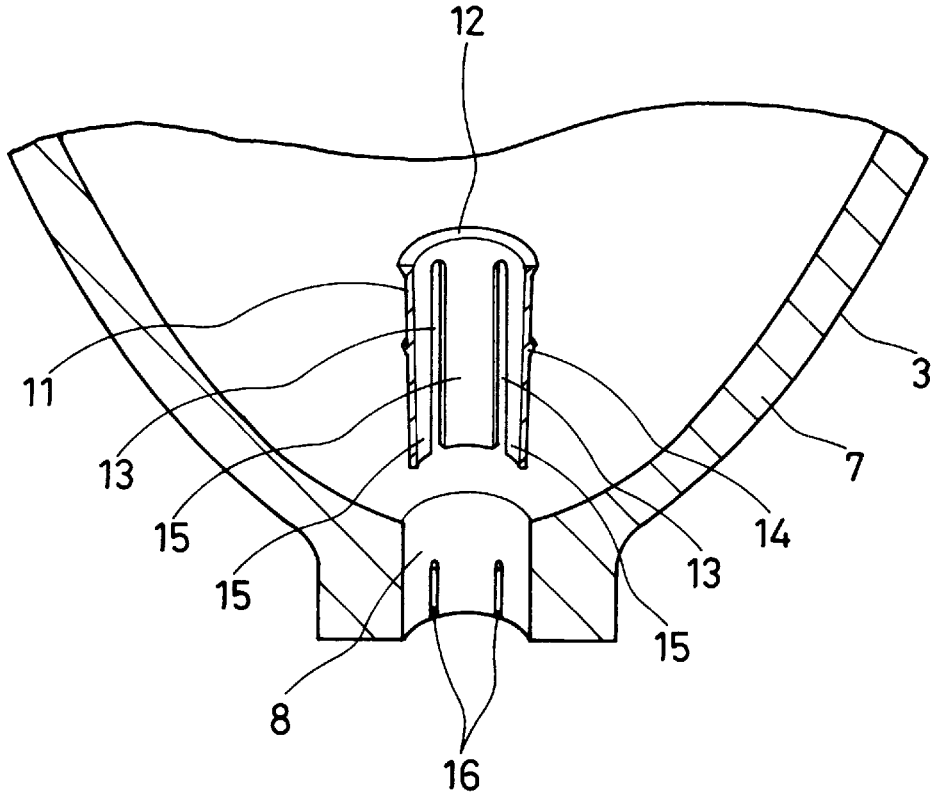
FIG. 2 is a cross sectional perspective view showing a part of a reflector and a hollow metal fitting of the lamp with a reflector according to the first embodiment of the present invention.

As shown in FIG. 2, the metal fitting 11 has a stopper 12 on the circumference of one end positioned on the reflecting surface portion 7 side. The stopper 12 is caught by one end of the hole 8. In the stopper 12, the portion projecting from the cylindrical face of the metal fitting 11 may have a height of 0.5 mm. The metal fitting 11 is provided with four slits 13 (two of them are not shown in the figure) formed by cutting portions of the metal fitting 11 from the end on the opposite side to the stopper 12 in parallel to the axis of the cylindrical metal fitting 11 (hereinafter referred to as a "cylindrical axis"). Further, on the side face of the metal fitting 11, a projection 14 (for example, with a height of 0.5 mm) is provided. The projection 14 contacts with the end on the opposite side to the side on which the stopper 12 is caught in the hole 8. The metal fitting 11 may have an outer diameter of 12 mm except for the portions of the stopper 12 and the projection 14 and an overall length of 15 mm. Each slit 13 may have a length of 12 mm and a width of 2 mm.

When the metal fitting 11 is inserted into the hole 8, the stopper 12 is caught by one end of the hole 8, thus preventing the metal fitting 11 from being inserted into the hole 8 beyond a predetermined depth.

By providing the slits 13, four tongue portions 15 (one of them is not shown in the figure) are formed at one end of the metal fitting 11. Due to elastic deformation of the tongue portions 15, the lamp is tilted easily in any direction after the base 2 has been inserted into the metal fitting 11, thus facilitating the position adjustment of the lamp 1 inside the reflector 3. However, after the base 2 and the metal fitting 11 are welded as described later, the elastic deformation of the metal fitting 11 is suppressed, and thus the lamp 1 is fixed firmly inside the reflector 3.

Figure 3:
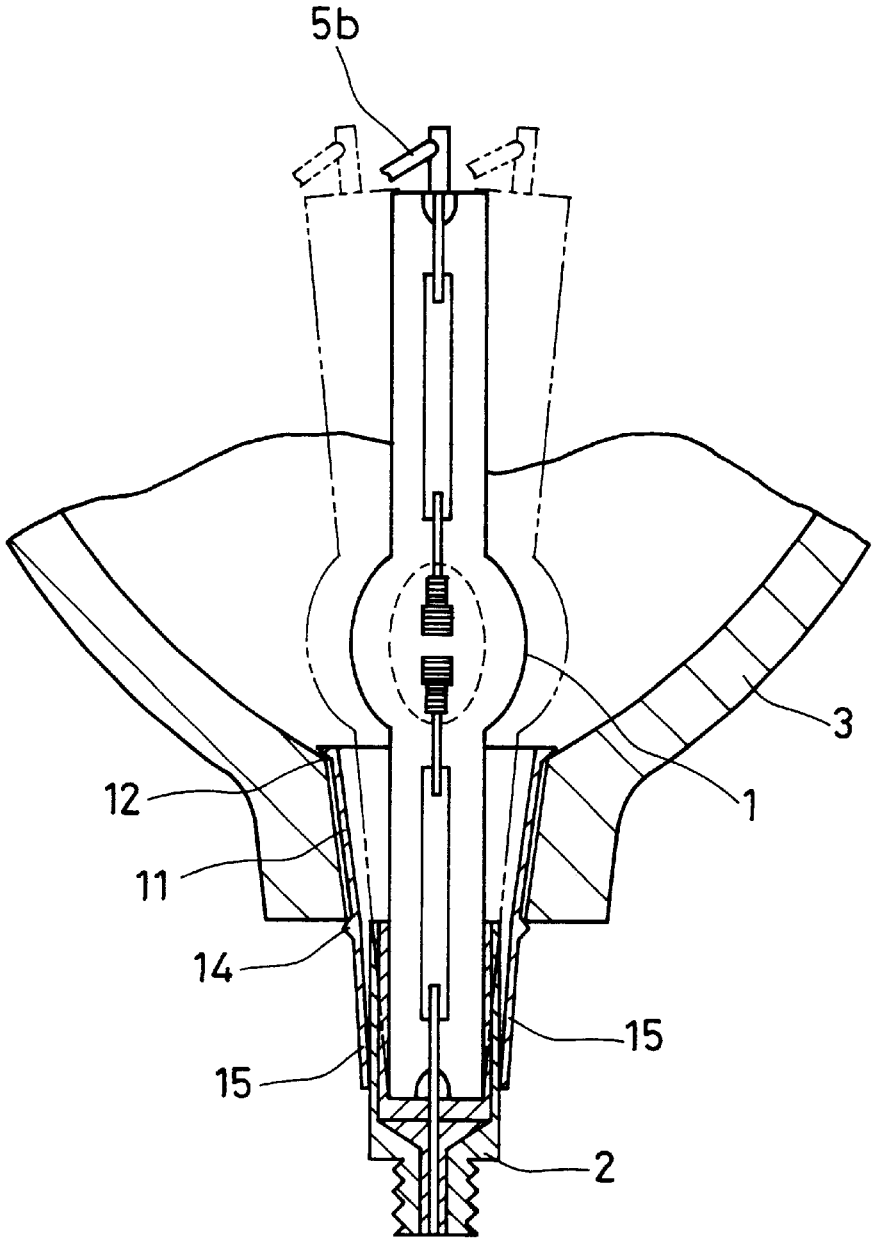
FIG. 3 is an enlarged cross sectional view of part of the lamp with a reflector according to the first embodiment of the present invention.

Since the hole 8 has a tapered shape as described above, the tongue portions 15 are deformed to have their tips closer to one another when the metal fitting 11 is inserted into the hole 8, thus deforming the metal fitting 11 into a tapered shape. Thus, the contact force between the base 2 and the tongue portions 15 is increased when the base 2 is inserted into the metal fitting 11. As a result, the lamp 1 can be maintained firmly in the metal fitting 11. At the same time, the base 2 seeks to press and expand the tongue portions 15, and therefore the further intimate contact between the metal fitting 11 and the hole 8 also can be attained. In addition, as shown in FIG. 3, when the metal fitting 11 is deformed into a tapered shape, a tilting space for adjusting the position of the lamp 1 by tilting it can be secured sufficiently between the base 2 and the metal fitting 11, thus facilitating the position adjustment of the lamp 1.

Since the metal fitting 11 is provided with the projection 14, the tongue portions 15 are deformed in the direction toward the center of the metal fitting 11 when the metal fitting 11 is inserted into the hole 8. Therefore, a slight gap is formed between the hole 8 and the metal fitting 11 as shown in FIG. 1. In this state, when the base 2 is inserted into the metal fitting 11, the side face of the metal fitting 11 is pressed strongly in the direction of the inner face of the hole 8, thus fixing the metal fitting 11 firmly inside the hole.

Since the metal fitting 11 is fit tightly inside the hole 8, it does not rotate easily in its circumference direction. However, as shown in FIG. 2, the rotation in the circumference direction can be further suppressed by providing projections 16 for engaging with the slits 13 on the inner face of the hole 8 and allowing them to be engaged with each other. Consequently, when the lead wire 5*a* is connected to the base 2 by thread fastening of the nut 2*b* after the welding of the base 2 and the metal fitting 11, the strength that can resist the rotational torque of the thread fastening sufficiently can be obtained.

The number of the slits 13 is not limited to four, and it may be acceptable as long as at least one slit is provided. It is preferred to provide three or five slits 13 that enable tongue portions 15 to be elastically deformed optimally. However, when too many slits 13 are provided, the elasticity of the tongue portions 15 is decreased, which is not preferable. In addition, it is preferable that when the projections 16 are provided, the slits 13 are formed in parallel to the cylindrical axis of the metal fitting 11 so as to engage with the projections 16 easily as described above. In the cases other than that, the slits 13 may have, for example, shapes distorted with respect to the cylindrical axis of the metal fitting 11.

Next, a method of manufacturing such a lamp with a reflector is described as follows.

Figure 4:
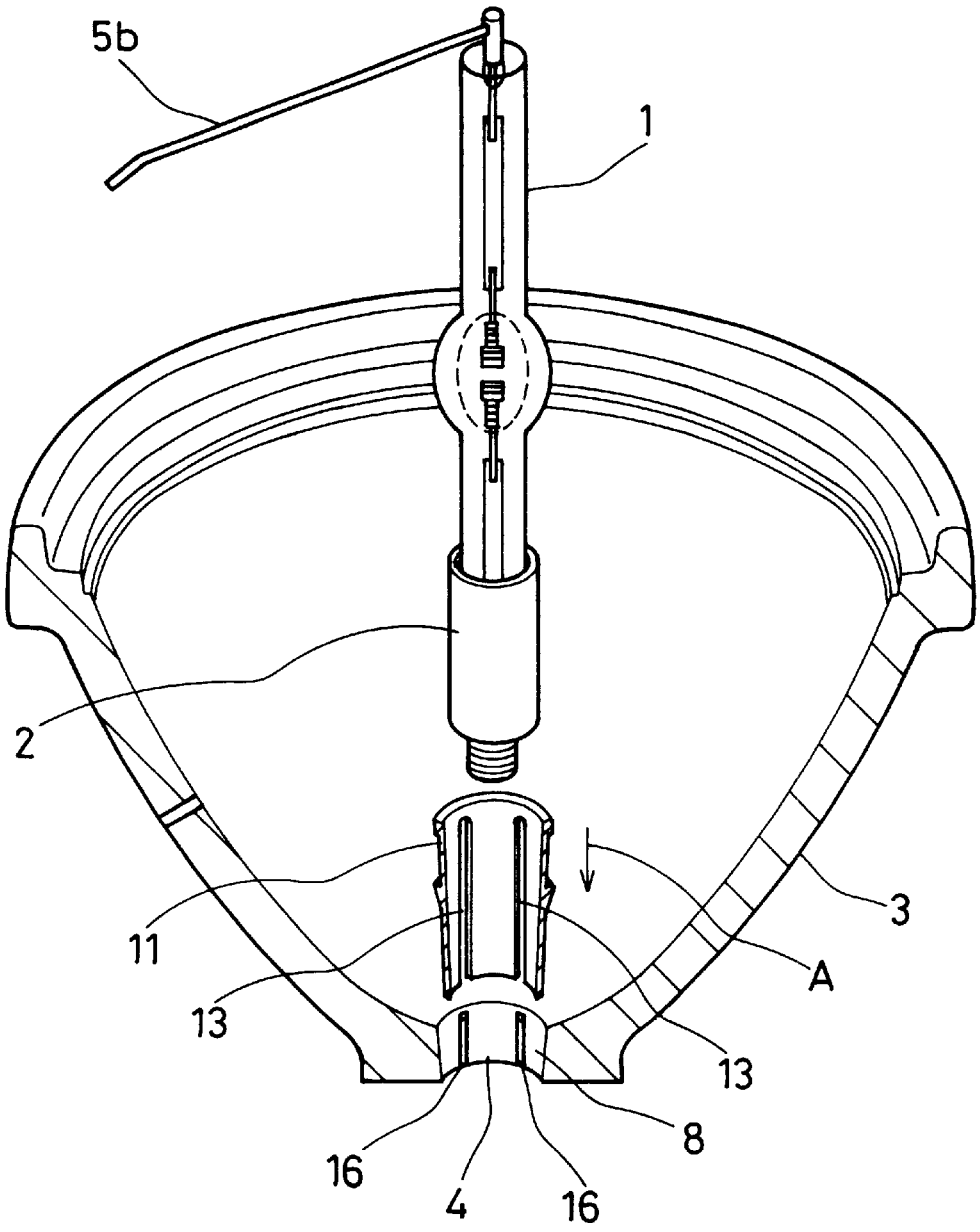
FIG. 4 is a cross sectional perspective view showing a method of manufacturing the lamp with a reflector according to the first embodiment of the present invention.
Figure 5:
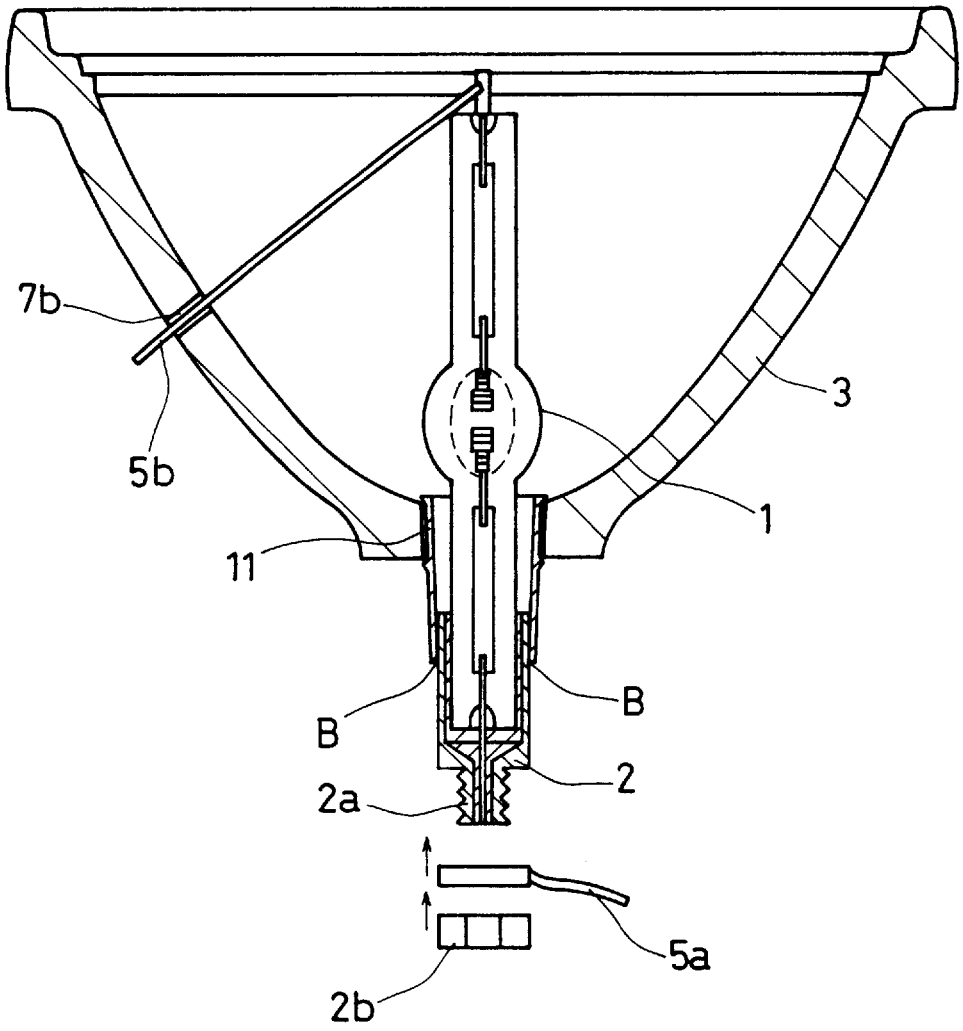
FIG. 5 is a cross sectional view showing the method of manufacturing the lamp with a reflector according to the first embodiment of the present invention.

As shown in FIG. 4, initially the metal fitting 11 is inserted into the hole 8 in the A direction so that the slits 13 are engaged with the projections 16, thus fitting the metal fitting 11 into the hole 8 in the state shown in FIG. 1 or FIG. 3. For this fitting, no adhesive is used. A portion of the lamp 1 on the base 2 side is inserted into the metal fitting 11 in the A direction. Then, the lead wire 5*b* is passed through the hole 7*b* that has been provided in the reflector 3 beforehand as shown in FIG. 5.

As a next step, two lead wires (not shown in the figure) connected to a power supply are connected to the base 2 and the lead wire 5*b* respectively to turn on the lamp 1. When turning it on, the lamp 1 is rotated 90 degrees from the state shown in FIG. 1 to have its axis horizontally. In such a horizontal turn-on state, the position of the lamp 1 is adjusted by tilting the lamp 1 as shown in FIG. 3 so that the light-emitting portion is positioned at the focal point of the reflector 3. After this position adjustment, four points in the portion where the base 2 and the metal fitting 11 contact with each other are welded by a laser. Thus, the base 2 and the metal fitting 11 are combined into one component and therefore the lamp 1 is fixed firmly inside the reflector 3. After that, the front glass 9 is attached to the opening portion 6 and is fixed by a clamp 10. Then, a terminal of the lead wire 5*a* is inserted into the threaded portion 2*a* and is fixed by thread fastening of the nut 2*b*, thus obtaining a lamp with a reflector as shown in FIG. 1.

It is preferable that the points for welding the base 2 and the metal fitting 11 are positioned particularly at the boundary portion (the portion B in FIG. 5) between the base 2 and one end of the metal fitting 11. This is because the base 2 and the metal fitting 11 can be welded at their boundary portion easier and more reliably compared to the case where the base 2 and the metal fitting 11 are welded through the side face other than the one end of the metal fitting 11.

According to the above-mentioned configuration, the position of the lamp 1 can be adjusted easily. Further, since an adhesive as in a conventional lamp is not used, the lamp 1 can be fixed firmly inside the reflector 3 in a short time and a drying process and equipment required for the process can be omitted. In addition, the occurrence of defective lamps caused by adhesion of an adhesive onto the reflecting surface 7 or the like can be prevented.

Second Embodiment

Figure 6:
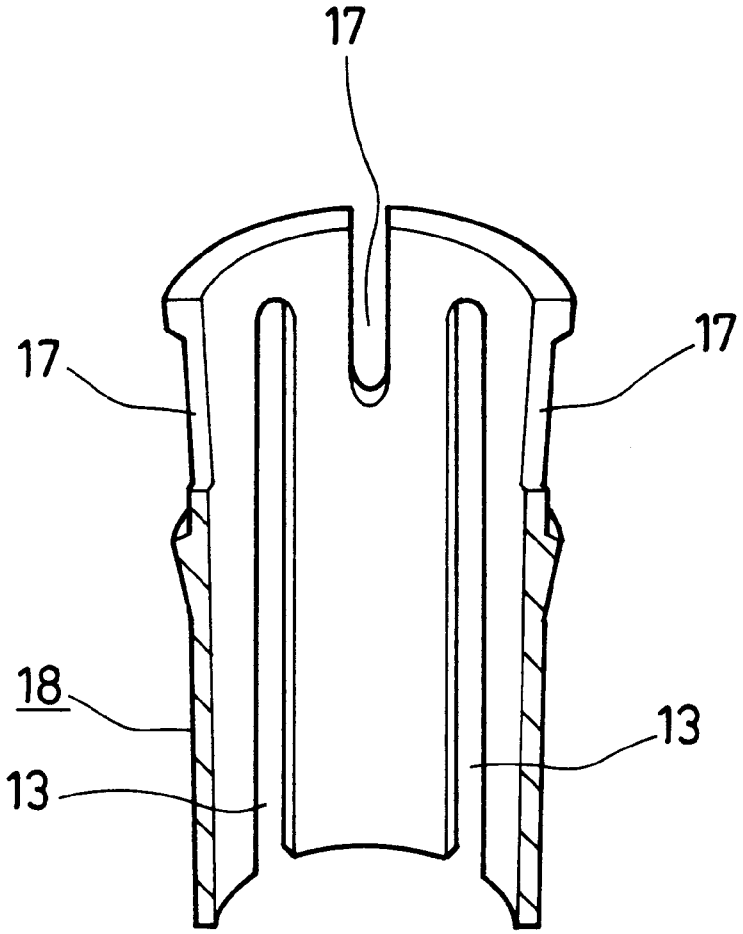
FIG. 6 is an enlarged cross sectional perspective view showing a hollow metal fitting of a lamp with a reflector according to a second embodiment of the present invention.

A lamp with a reflector according to a second embodiment of the present invention is described with reference to FIG. 6. FIG. 6 shows a cylindrical metal fitting 18 used in the present embodiment. This metal fitting 18 has a configuration in which four slits 17 (one of them is not shown in the figure) each of which may have a length of 4 mm and a width of 2 mm are further provided for the cylindrical metal fitting 11 shown in FIG. 2. The present embodiment employs the same configuration as that of the lamp with a reflector shown in FIG. 1 except that this metal fitting 18 is used to be fit into a hole 8.

The slits 17 are provided by cutting portions of the metal fitting 18 in parallel to the cylindrical axis of the metal fitting 18 from the opposite direction to the slits 13 in the metal fitting 11 shown in FIG. 2.

The number of the slits 17 is not limited to four, and it may be acceptable as long as at least one slit is provided. It is preferred to provide three or five slits 13 that enable the portions where the slits 17 are formed in the metal fitting 18 to have optimum mechanical strength. However, when too many slits 13 are provided, the mechanical strength of the portions where the slits 17 are formed in the metal fitting 18 is decreased, which is not preferable. In addition, although the slits 17 are formed in parallel to the cylindrical axis of the metal fitting 18 in FIG. 6, it is not always necessary to form the slits 17 in such a manner. For instance, the slits 17 may have shapes distorted with respect to the cylindrical axis of the metal fitting 18.

A reflector 3 and the metal fitting 18 are thermally expanded due to the heat generated in a high-pressure mercury lamp 1. Therefore, particularly since the reflector 3 and the metal fitting 18 are fit with each other in the hole 8, the vicinity of the hole 8 may be broken due to the difference in coefficient of thermal expansion between them in some cases. However, by providing the slits 17 for the metal fitting 18 as described above, the thermal expansion of the metal fitting 18 can be absorbed by the width of the slits being reduced. As a result, the vicinity of the hole 8 can be prevented from being broken.

Third Embodiment

Figure 7:
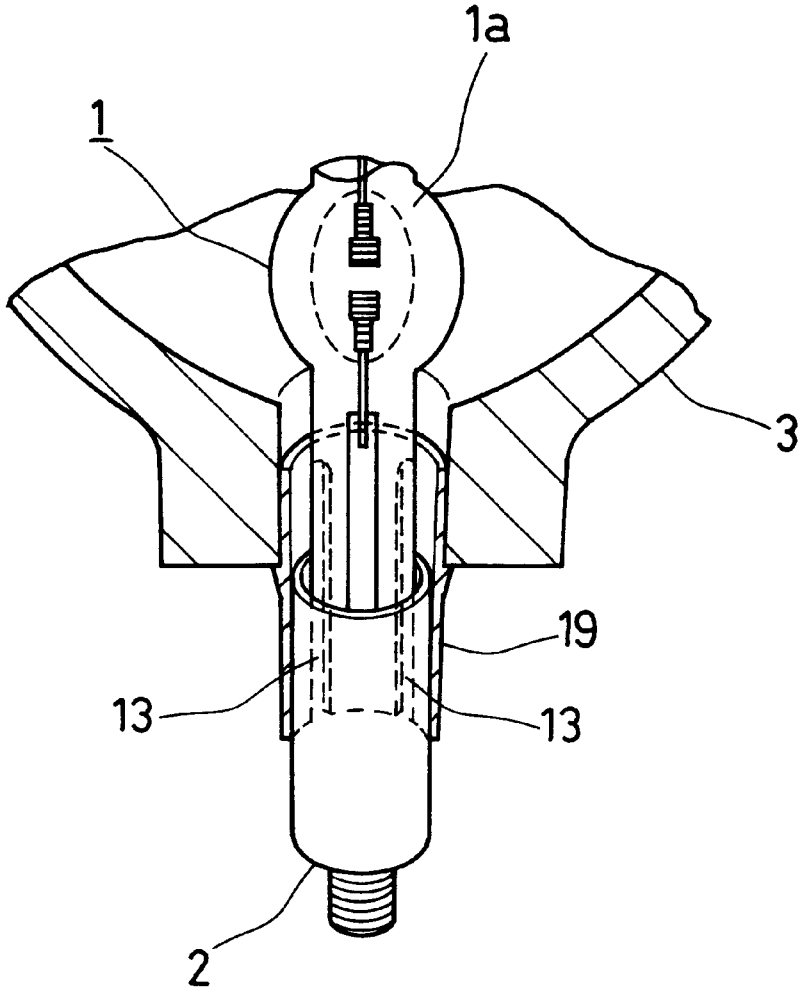
FIG. 7 is an enlarged cross sectional perspective view showing part of a lamp with a reflector according to a third embodiment of the present invention.

A lamp with a reflector according to a third embodiment of the present invention is described with reference to FIG. 7. FIG. 7 shows an enlarged view of the vicinity of the portion where a high-pressure mercury lamp 1 is fixed to a reflector 3. A cylindrical metal fitting 19 is different from the metal fitting 11 shown in FIG. 2 in that the stopper 12 is not provided. The present embodiment employs the same configuration as that of the lamp with a reflector shown in FIG. 1 except that the metal fitting 19 is inserted into the hole 8 about 3-mm deeper compared to the state of the metal fitting 11 shown in FIG. 1.

Since the heat generated at a light-emitting portion 1*a* in the lamp 1 causes temperature rise in the metal fitting 11 as shown in FIG. 1, the metal fitting 11 is oxidized, thus decreasing the mechanical strength or the elasticity of the metal fitting 11. However, according to the configuration shown in FIG. 7, the metal fitting 19 can be kept away from the light-emitting portion 1*a* of the lamp 1, thus suppressing the temperature rise in the metal fitting 19 due to the heat generated at the light-emitting portion 1*a*. Thus, the oxidation and the decrease in elasticity of the metal fitting 19 can be prevented. In addition, even when the stopper 12 as in the metal fitting 11 is not provided, the metal fitting 19 is prevented from being inserted into the hole 8 beyond a predetermined extent because the slits 13 are caught by projections 16 (not shown in FIG. 7).

Fourth Embodiment

Figure 8:
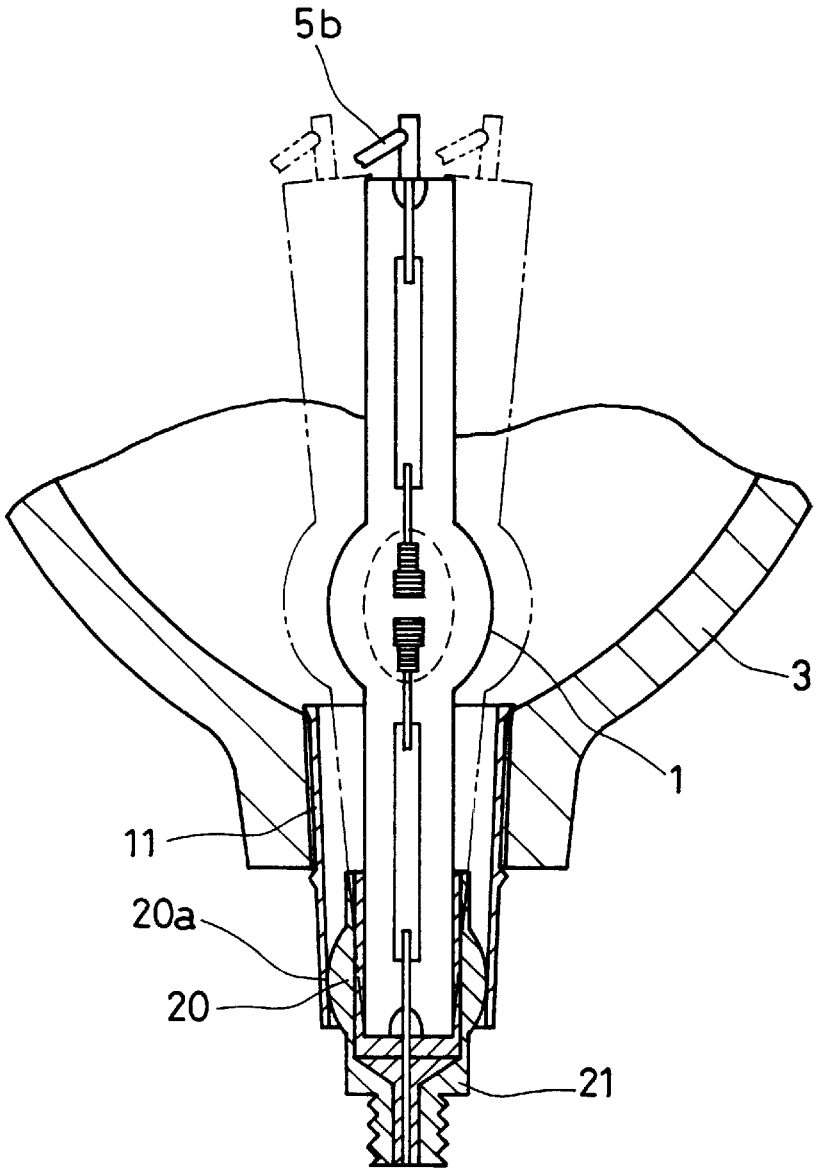
FIG. 8 is an enlarged cross sectional view showing part of a lamp with a reflector according to a fourth embodiment of the present invention.

A lamp with a reflector according to a fourth embodiment of the present invention is described with reference to FIG. 8. FIG. 8 shows an enlarged view of the vicinity of the portion where a high-pressure mercury lamp 1 is fixed to a reflector 3. In the present embodiment, a base 21 is different from the base 2 shown in FIG. 1. The base 21 is provided with a projection 20 formed of a part of a spherical body on its side face. The present embodiment is the same as the lamp with a reflector shown in FIG. 1 except that a top part 20*a* of the projection 20 is brought into contact with the inner face of a cylindrical metal fitting 11.

According to this configuration, in tilting the lamp 1, a constant sliding frictional force between the base 21 and the inner face of the metal fitting 11 can be obtained. Therefore, the position of the lamp 1 can be adjusted easily. Furthermore, a large gap can be formed between the lamp 1 and the metal fitting 11 and therefore a tilting space for the lamp 1 can be secured sufficiently, thus facilitating the position adjustment of the lamp 1.

Fifth Embodiment

Figure 9:
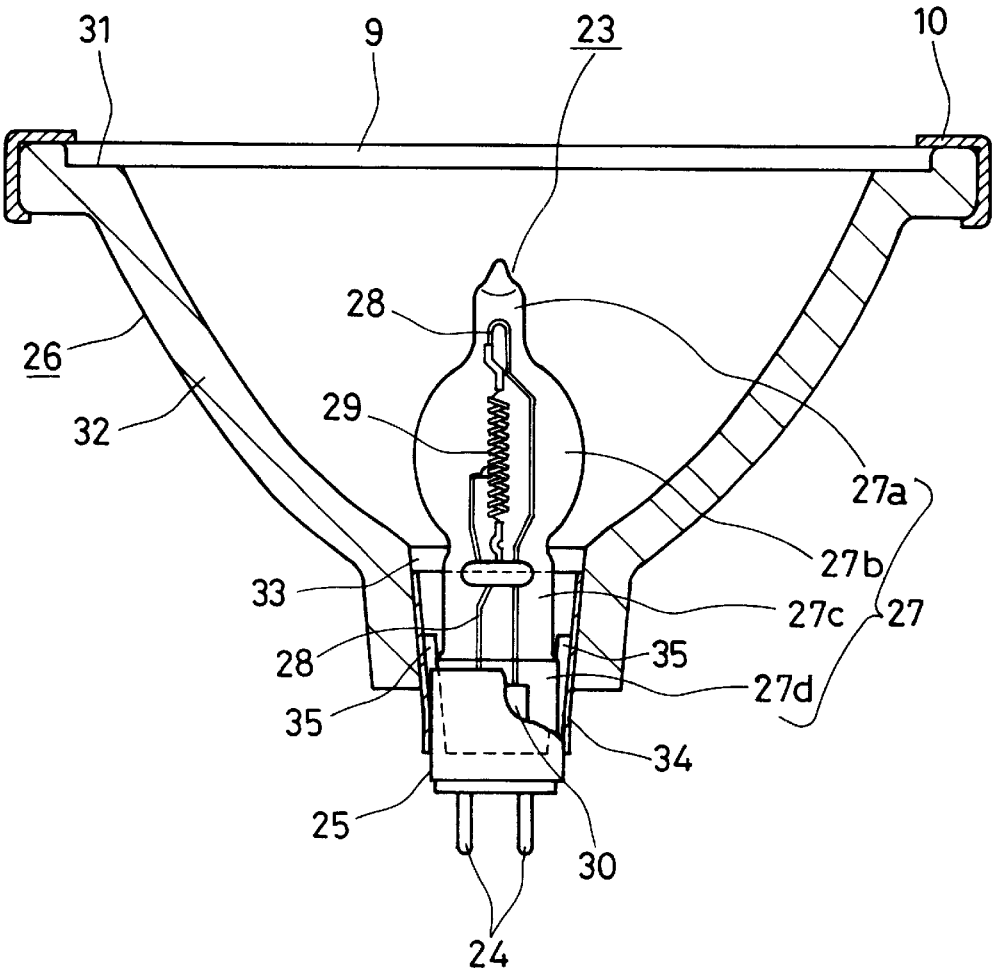
FIG. 9 is a cross sectional view of a lamp with a reflector according to a fifth embodiment of the present invention.

FIG. 9 shows a lamp with a reflector according to a fifth embodiment of the present invention. The lamp with a reflector includes a tungsten halogen lamp 23 with a rated power of 50W, a metal base 25, and a glass reflector 26. The base 25 is fixed to one end of the lamp 23 with an adhesive (not shown in the figure) such as cement and is provided with two pins 24 at one end. The lamp 23 is positioned inside the reflector 26.

The lamp 23 may have an overall length of 42 mm and a maximum outer diameter of 11 mm and may include a discharge tube 27 made of quartz glass that is formed sequentially and continuously of a closed portion 27*a*, an expanded portion 27*b*, a tube-like portion 27*c*, and a sealing portion 27*d*. Inside the discharge tube 27, a filament coil 29, for example, made of tungsten that is supported by two inner lead wires 28 is provided. The inner lead wires 28 are connected to outer lead wires (not shown in the figure) respectively through lead-in foils 30 (only one of two is shown in the figure), for example, made of molybdenum that are sealed inside the sealing portion 27*d*. The outer lead wires (not shown in the figure) are connected to the pins 24, respectively. Inside the discharge tube 27, a predetermined amount of inert gas and a predetermined amount of halogenide are sealed.

In turning on the lamp 23, a connector (not shown in the figure) connected to a power supply is connected to the pins 24 of the base 25.

The reflector 26 is provided with an opening portion 31 on its front side through which light is emitted, a reflecting surface portion 32 having a paraboloidal or ellipsoidal reflecting surface that is provided in continuation of the opening portion 31, and a hole 33 provided in continuation of the reflecting surface portion 32. The opening portion 31 has, for example, an outer diameter of 50 mm and a front glass 9 is fixed to the opening portion 31 by a clamp 10. The hole 33 may have a depth of 12 mm and inner sizes of 14 mm×6 mm at the end of the opening portion 31 side and 12 mm×5 mm at the other end. Thus, the hole 33 has a tapered shape.

Into the hole 33, a hollow metal fitting 34 is fit with about ⅓ of its overall length projecting to the outside of the reflector 26. The metal fitting 34 may have an overall length of 15 mm and the cross section orthogonal to the longitudinal axis of the metal fitting 34 has a rectangular shape. The hole 33 also is rectangular in cross section. The base 25 is inserted into the metal fitting 34 and they are combined into one component by welding. Thus, the lamp 23 is fixed inside the reflector 26.

Figure 10:
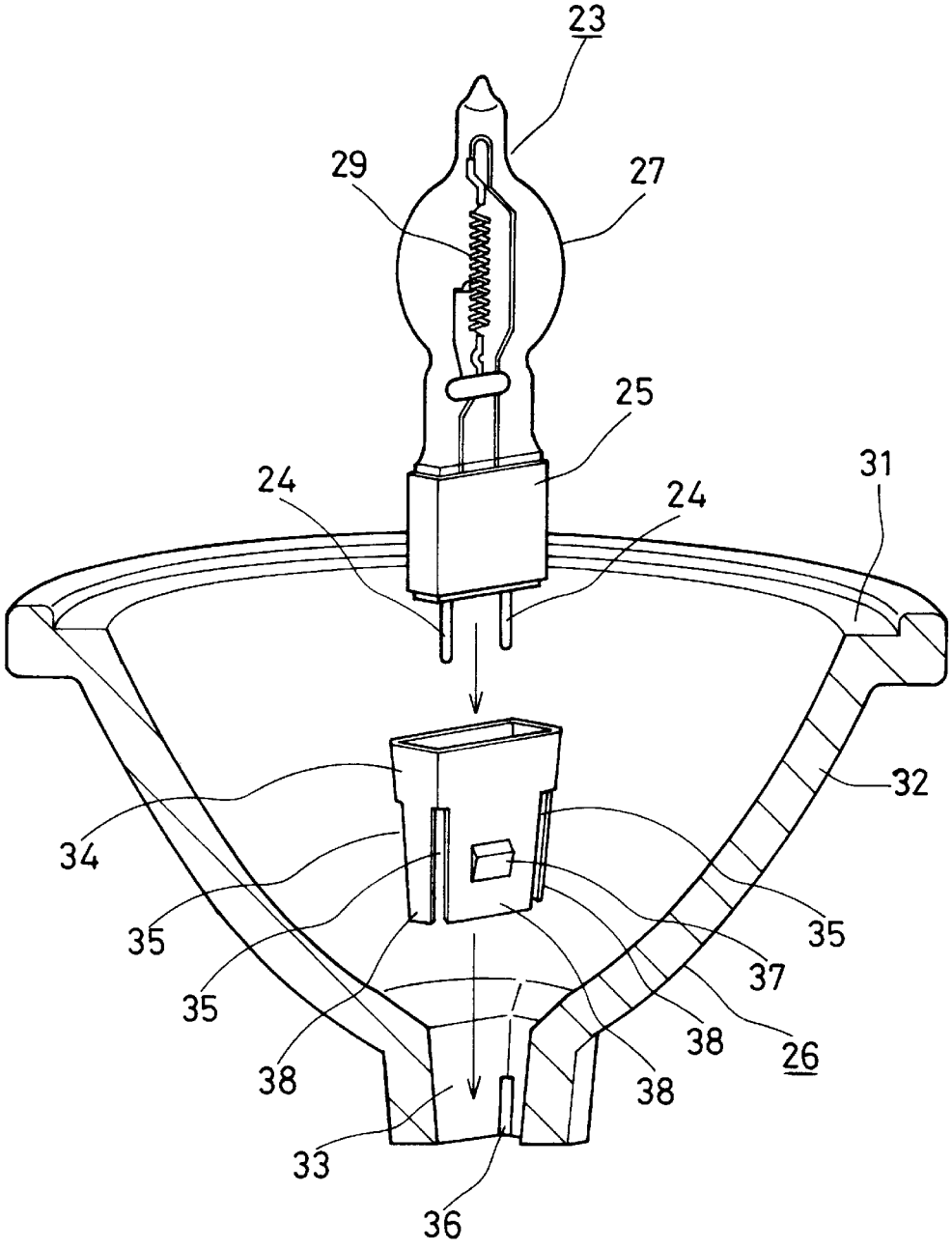
FIG. 10 is a cross sectional perspective view showing a method of manufacturing the lamp with a reflector according to the fifth embodiment of the present invention.
Figure 11:
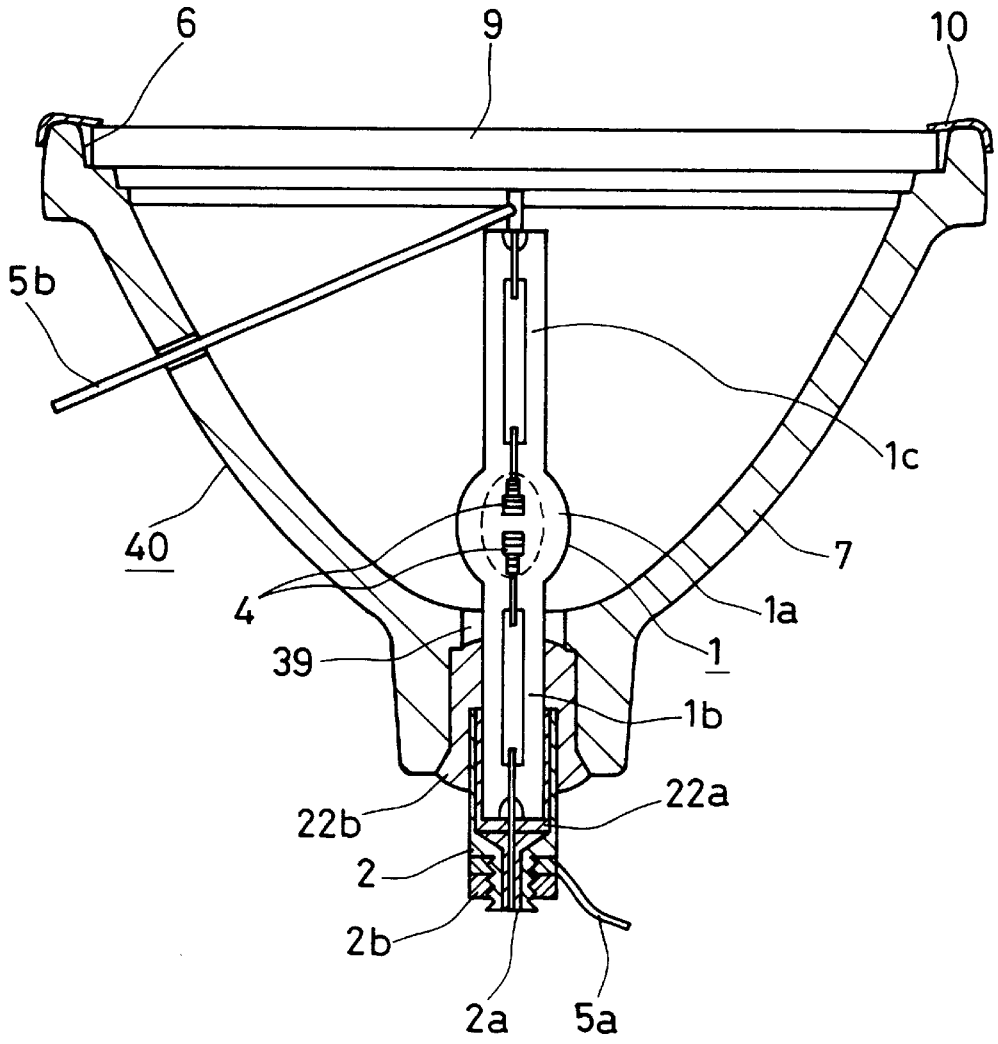
FIG. 11 PRIOR ART
FIG. 11 is a cross sectional view of a conventional lamp with a reflector.

As shown in FIG. 10, the metal fitting 34 is provided with four slits 35 (two of them are not shown in the figure) by cutting its four corners parallel to the longitudinal axis of the metal fitting 34 so that each slit has, for example, a width of 2 mm and a length of 10 mm. When the metal fitting 34 is inserted into the hole 33, the slits 35 are engaged with ribs 36 formed at four corners on the inner face of the hole 33. Furthermore, projections 37 (only one of two is shown in the figure) are provided at approximately the centers of two side faces having larger area out of the four side faces of the metal fitting 34.

As described above, the engagement of the slits 35 with the ribs 36 can prevent the metal fitting 34 from being inserted into the hole 33 beyond a predetermined length.

By providing the slits 35, four tongue portions 38 (one of them is not shown in the figure) are formed at one end of the metal fitting 34. Due to elastic deformation of the tongue portions 38, the lamp 23 is tilted easily in any direction after the insertion of the base 25 into the metal fitting 34, thus facilitating the position adjustment of the lamp 23 inside the reflector 26. However, after the base 25 and the metal fitting 34 are welded, the elastic deformation of the metal fitting 34 is suppressed and therefore the lamp 23 is fixed firmly inside the reflector 26.

Since the hole 33 has a tapered shape as described above, upon the insertion of the metal fitting 34, the tongue portions 38 are deformed to have their tips closer to one another. Thus, the metal fitting 34 is deformed into a tapered shape. Consequently, when the base 25 is inserted into the metal fitting 34, the contact force between the base 25 and the tongue portions 38 increases and thus the lamp 23 is maintained firmly in the metal fitting 34. At the same time, since the base 25 seeks to press and expand the tongue portions 38, the further intimate contact between the metal fitting 34 and the hole 33 also can be attained. When the metal fitting 34 is deformed into a tapered shape, a tilting space for adjusting the position of the lamp 23 by tilting it can be secured sufficiently between the base 25 and the metal fitting 34. Thus, the position of the lamp 23 can be adjusted easily.

Since the projections 37 are provided for the metal fitting 34, the tongue portions 38 are deformed in the direction toward the center of the metal fitting 34 when the metal fitting 34 is inserted into the hole 33. Thus, a slight gap is formed between the hole 33 and the metal fitting 34, which is not shown in the figure. In this state, when the base 25 is inserted into the metal fitting 34, the side face of the metal fitting 34 is pressed strongly in the direction of the inner face of the hole 33. Consequently, the metal fitting 34 can be fixed firmly inside the hole 33.

A method of manufacturing such a lamp with a reflector is described as follows.

As shown in FIG. 10, initially the metal fitting 34 is inserted into the hole 33 so that the slits 35 are engaged with the ribs 36, thus allowing the metal fitting 34 to be fit into the hole 33. For this fitting, no adhesive is used. Then, a portion of the lamp 23 on the base 25 side is inserted into the metal fitting 34. As a next step, a connector (not shown in the figure) connected to a power supply is connected to the base 25 to turn on the lamp 23. In this turn-on state, the position of the lamp 23 is adjusted by tilting the lamp 23 so that the lamp is positioned at the focal point of the reflector 26. After this position adjustment, four points in the portion where the base 25 and the metal fitting 34 contact with each other are welded by a laser. Thus, the base 25 and the metal fitting 34 are combined into one component and therefore the lamp 23 is fixed firmly inside the reflector 26. After that, a front glass 9 is attached to the opening portion 31 and is fixed by a clamp 10. Thus, a lamp with a reflector as shown in FIG. 9 can be obtained.

According to the configuration described above, the position of the lamp 23 can be adjusted easily. Further, since an adhesive as in a conventional lamp is not used, the lamp 23 can be fixed firmly inside the reflector 26 in a short time and a drying process and equipment required for the process can be omitted. In addition, the occurrence of defective lamps caused by adhesion of an adhesive onto the reflecting surface 32 or the like can be prevented.

The sizes of respective parts described in the above-mentioned embodiments are indicated as examples and can be changed according to the shape and size of a lamp within a range in which technical effects according to respective embodiments are not deteriorated.

As described above, according to a lamp with a reflector of the present invention, since a base and a hollow metal fitting are combined into one component by welding, a configuration in which a lamp is fixed firmly inside a reflector can be obtained.

A method of manufacturing a lamp with a reflector of the present invention enables the position of a lamp inside a reflector to be adjusted easily. Furthermore, no process for drying an adhesive is required, thus enabling the lamp to be fixed firmly inside the reflector in a short time. In addition, a process of drying an adhesive and equipment for the process can be omitted and the occurrence of defects caused by adhesion of an adhesive onto the portion where no adhesive is necessary can be prevented.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A lamp with a reflector, comprising:

a lamp having a base at one end;

a reflector having a reflecting surface, a hole formed at one end of the reflecting surface, and an opening portion at the other end, the hole having a tapered shape with a portion on a side of the opening portion being wider; and a hollow metal fitting having at least one slit formed by being cut from an end on an opposite side to the opening portion of the reflector so as to form a tongue portion having elasticity, the base being inserted into and maintained in the hole, so that the lamp is positioned inside the reflector, wherein the hollow metal fitting is fit into the hole with the tongue portion being deformed into a tapered shape along the inner surface of the hole so as to be pressed against an inner surface of the hole, the base is inserted into the hollow metal fitting with the tongue portion being pressed against the outer surface of the base, and the base and the hollow metal fitting are combined into one component by welding the base and the tongue portion together.

2. The lamp with a reflector according to claim 1, wherein the base and the hollow metal fitting are welded at their boundary portion.

3. The lamp with a reflector according to claim 1, wherein the hole is provided with a projection or a rib that engages with the slit.

4. The lamp with a reflector according to claim 1, wherein a projection is provided on a side face of the hollow metal fitting and the projection contacts with an inner face of the hole.

5. The lamp with a reflector according to claim 1, wherein the slit is formed to extend to the vicinity of an end positioned on a side of the reflector.

6. The lamp with a reflector according to claim 1, wherein a stopper to be caught by an end of the hole on a side of the opening portion is provided at one end of the hollow metal fitting on a side of the opening portion.

7. The lamp with a reflector according to claim 1, wherein the hollow metal fitting has at least one slit formed by being cut from an end of a side of the opening portion of the reflector.

8. The lamp with a reflector according to claim 1, wherein a projection formed of a part of a spherical body is provided on a side face of the base and a top part of the projection contacts with an inner face of the hollow metal fitting.

9. A method of manufacturing a lamp with a reflector, the lamp with a reflector comprising:

a lamp having a base at one end;

a reflector having a reflecting surface, a hole formed at one end of the reflecting surface, and an opening portion at the other end, the hole having a tapered shape with a portion on a side of the opening portion being wider; and a hollow metal fitting having at least one slit formed by being cut from an end on an opposite side to the opening portion of the reflector so as to form a tongue portion having elasticity, the base being inserted into and maintained in the hole, so that the lamp is positioned inside the reflector, wherein the method comprises:

fitting the hollow metal fitting into the hole, the tongue portion being deformed into a tapered shape along the inner surface of the hole so as to be pressed against an inner surface of the hole;

inserting the base into the hollow metal fitting so as to be pressed against the inner surface of the tongue portion; and then combining the base and the hollow metal fitting into one component by welding the base and the tongue portion together.

* * * * *